US006595163B2

(12) United States Patent
Dumaz et al.

(10) Patent No.: US 6,595,163 B2
(45) Date of Patent: Jul. 22, 2003

(54) HIGH PRESSURE STEAM WATER INJECTOR COMPRISING AN AXIAL DRAIN

(75) Inventors: Patrick Dumaz, Aix-en-Provence (FR); Bertrand Duc, Pertius (FR)

(73) Assignee: Commissariat a l'Energie Atomique, Paris (FR)

( * ) Notice: Subject to any disclaimer, the term of this patent is extended or adjusted under 35 U.S.C. 154(b) by 0 days.

(21) Appl. No.: 10/130,008

(22) PCT Filed: Nov. 29, 2000

(86) PCT No.: PCT/FR00/03330

§ 371 (c)(1),
(2), (4) Date: May 9, 2002

(87) PCT Pub. No.: WO01/40661

PCT Pub. Date: Jun. 7, 2001

(65) Prior Publication Data

US 2002/0162518 A1 Nov. 7, 2002

(30) Foreign Application Priority Data

Nov. 30, 1999 (FR) ..... 99 15065

(51) Int. Cl.[7] ..... F22D 7/04

(52) U.S. Cl. ..... 122/404; 376/407; 239/434.5; 137/896

(58) Field of Search ..... 122/404; 376/298, 376/299, 372, 392, 407; 239/434.5, 590.3; 137/602, 896

(56) References Cited

U.S. PATENT DOCUMENTS

| | | | | |
|---|---|---|---|---|
| 1,457,777 A | | 6/1923 | Kirgan | |
| 2,245,839 A | * | 6/1941 | Tinker | 417/166 |
| 2,288,777 A | * | 7/1942 | Bosonetto et al. | 417/192 |
| 3,200,764 A | | 8/1965 | Saunders, Jr. | |
| 4,873,829 A | * | 10/1989 | Williamson | 60/670 |
| 5,262,091 A | * | 11/1993 | Narabayashi et al. | 261/21 |
| 5,323,967 A | * | 6/1994 | Tanaka et al. | 239/417.3 |
| 5,462,229 A | * | 10/1995 | Tanaka et al. | 239/397.5 |
| 5,896,435 A | * | 4/1999 | Gautier et al. | 376/407 |

FOREIGN PATENT DOCUMENTS

| | | | |
|---|---|---|---|
| DE | 38 911 | | 4/1887 |
| DE | 146 341 | | 12/1903 |
| DE | 465952 | | 9/1928 |
| EP | 0514914 A2 | * | 11/1992 |
| FR | 521624 | | 7/1921 |
| JP | 8211183 A | * | 8/1996 |

* cited by examiner

*Primary Examiner*—Jiping Lu
(74) *Attorney, Agent, or Firm*—Pearne & Gordon LLP

(57) ABSTRACT

The steam injector is characteristic in its high pressure and improved start-up. It uses an axial drain (10) positioned in the centre of the neck (5) downstream from the mixing chamber (4) and inserted in the diffuser (7) for the purpose of narrowing the section of the neck (5) and evacuating a large part of the steam which has not been condensed. The axial drain (10) may be mounted so that it is axially mobile.

Application to the water supply for steam generators in pressurized water nuclear reactors.

4 Claims, 3 Drawing Sheets

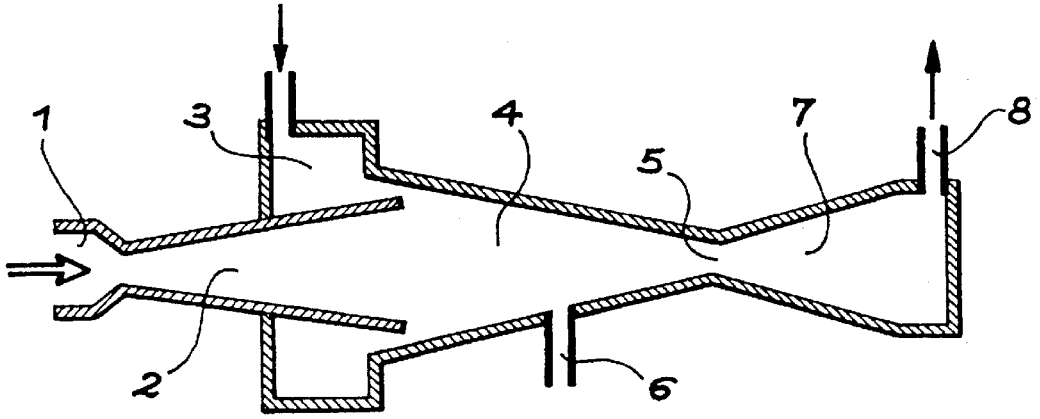
PRIOR ART FIG. 1
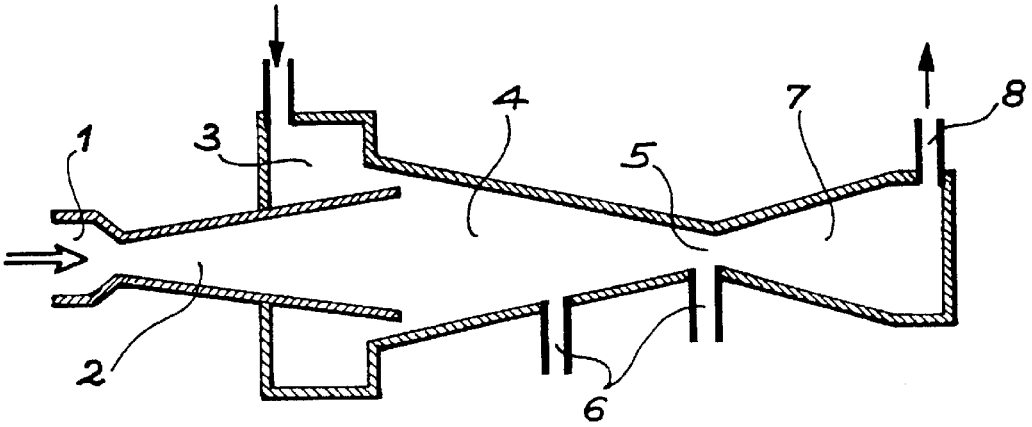
PRIOR ART FIG. 2

HIGH PRESSURE STEAM WATER INJECTOR COMPRISING AN AXIAL DRAIN

TECHNICAL FIELD

The invention relates to the area of high pressure injectors, intended to inject water into a machine or installation containing a pressurized reservoir. Generally, the latter is the steam production tank of a steam boiler. This is the case in particular for steam generators used in nuclear reactors, especially pressurized water reactors. However, the use of this type of injector could be applied to any type of steam-producing reservoir using part of this steam as driving energy source and a low pressure reservoir as water source.

PRIOR ART AND PROBLEM RAISED

For over a century the use of steam injectors has been known (see GIFFARD patent in 1850), in particular for steam engines such as locomotives and ships. Nowadays, these devices are especially used in industrial installations requiring the decanting of solutions or liquid waste likely to rapidly deteriorate conventional pumping systems. In water nuclear reactors, the use of injectors as an emergency supply has been examined. Such supply is intended to evacuate residual heat. In pressurized water reactors, the emergency supply to steam generators is made using electric motor pumps or turbopumps. These devices are difficult to design on account of their revolving parts and some depend upon electric sources. On this account, the use of passive devices has been researched, such as steam injectors which are able to raise the pressure of the water in the low pressure emergency reservoir to a pressure greater than the steam pressure. Up until now, the different injector prototypes put forward have been found to perform insufficiently and to be unreliable for use in nuclear reactors.

With reference to FIG. 1, the principle of a steam injector is to reduce the pressure of pressurized steam within a narrowing followed by an expanding nozzle 2, a Laval nozzle for example, so that the speed reached on leaving this tube is a supersonic speed with pressures possibly lower than atmospheric pressure. In a mixing chamber 4, a water inlet is provided via a ring-shaped entry chamber 3. In the mixing chamber 4, the water derived from the entry chamber 3 is aspirated under the low pressures, then the steam releases its energy to the water by condensing.

The mixing chamber 4 is generally cone-shaped and converges towards a neck 5. At this point, the water reaches its maximum speed. After the neck 5 is an outlet diffuser 7 through which the kinetic energy of the diphase mixture is converted into pressure and is accompanied by condensation of the steam that is non-condensed on leaving the mixing chamber 4. This pressure rise is abrupt and is sometimes compared to a stationary shock wave. To ensure its start-up, the steam injector requires a drain 6 positioned at the mixing chamber 4. This start-up may also be difficult to achieve as the drain must be properly positioned. In addition, once the injector has been primed, closure of the drain 6 may cause de-energizing of the steam injector (in general gradual closure is recommended) The maximum outlet pressure is greater the smaller the section of the neck passageway 5 located between the mixing chamber 4 and the diffuser 7. However, reducing the size of this section renders start-up of the device even more difficult.

Moreover, the use of two drains 6 (FIG. 2) makes it possible for some injectors to reach pressures of 70 bars to 90 bars. In this case, only the upstream drain is closed during normal functioning of the steam injector, the downstream drain remaining more or less open to evacuate a fairly considerable quantity of water, approximately 50%, for high pressure operation. The complex functioning and loss of water from this type of steam injector have meant that it could not be chosen for nuclear reactor installations.

The purpose of the invention is therefore to overcome these disadvantages by making available a steam injector which may be used in pressurized water reactors and which may inject water up to pressures in the region of 80 bars.

SUMMARY OF THE INVENTION

Therefore, the main subject of the invention is a high pressure steam injector comprising:

- a steam inlet leading into:
- a steam nozzle itself leading into:
- a mixing chamber;
- a ring-shaped entry chamber leading into the mixing chamber;
- a neck positioned at the mixing chamber exit,
- a diffuser positioned at the neck exit; and
- an outlet positioned downstream from the diffuser.

According to the invention, an axial drain formed of an evacuation duct is positioned in the middle of the neck to reduce the neck section and purge some of the steam which has not been condensed and to evacuate it towards the outside. It has been shown that flow remains essentially annular as far as the neck.

For the purpose of possibly using the drain temporarily or varying the minimum passageway section, the drain may be assembled with longitudinal mobility so that it can be moved relative to the neck.

To improve the efficacy of this drain, it may have a variable section.

A further embodiment provides a cone shape for the first part of the axial drain in which evacuation holes are provided, so that the steam can be drained progressively.

LIST OF DRAWINGS

The invention and its different technical characteristics will be better understood on reading the following description accompanied by several figures in which:

FIGS. 1 and 2, already described, show injectors of the prior art,

DETAILED DESCRIPTION OF EMBODIMENTS OF THE INVENTION

Figure 3:
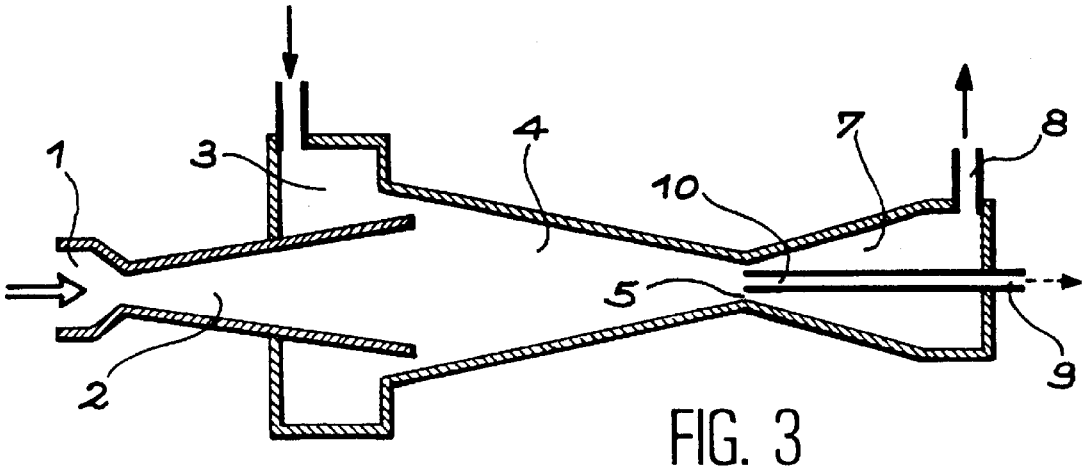
FIG. 3 shows a first embodiment of the injector of the invention.

With reference to FIG. 3, the injector of the invention reproduces the main parts of the steam injector of the prior art described with reference to FIG. 1, with the exception of the side evacuation drain 6. There is therefore a steam inlet 1 leading into a Laval nozzle 2, a ring-shaped entry chamber 3 leading into the mixing chamber 4, positioned at the outlet of nozzle 2 and ending in neck 5. A diffuser 7 is placed at the exit of the neck leading into an outlet 8. At the neck 5, an axial drain 10 is positioned that is formed of an evacuation duct and extends across diffuser 7 and ends on the outside 9, outside the steam injector that is the subject of this application. It has been shown that diphase flow remains essentially annular as far as the neck, the film of water being flattened against the wall of this mixing chamber 4. This experimental fact contradicts previously accepted knowledge, namely the more or less rapid spraying of the aspirated film of water. Said axial drain 10 captures the central part of the flow passing through neck 5 and hence a large quantity of the steam that is not condensed in the mixing chamber 4. However, this steam has released a large part of its energy to the liquid to be injected on account of the reduction in its speed between the inlet and outlet of the mixing chamber 4. Also, since this central flow of steam is slow, it cannot contribute towards the rise in pressure of the water in diffuser 7. Solely the annular parts of the flow passing through neck 5, that is to say liquid water, are ejected at high speed into diffuser 7 and then towards the outlet 8.

In addition, it can be easily understood that the axial drain 10 also makes it possible to reduce the section of the flow passageway at the neck 5, between the mixing chamber 4 and the diffuser 7, and hence makes it possible to increase the maximum pressure of the flow at outlet 8, compared with the case in which said axial drain is not used with the same diffuser. It is generally admitted that the increase in pressure is practically conversely proportional to the section of the passageway at neck 5.

It is to be noted that the axial drain 10 is also used for the start-up of the steam injector. In this case the steam inlet 1 is closed and the water supply is open, that is to say that the water circulates inside the ring-shaped entry chamber 3 and arrives in the mixing chamber 4. All or part of this water is discharged by the axial drain 10 towards the outside, following the notion of downstream discharge at outlet 8. When the steam inlet 1 is open, strong condensation occurs in the mixing chamber 4. The pressure in this mixing chamber then falls until it reaches its nominal value. The flow then becomes supersonic at the exit of nozzle 2. At the neck 5, the central flow, initially in the liquid state, becomes steam and is captured by the axial drain 10. The flow of water takes place annular fashion against the walls of neck 5 and extends into the diffuser 7.

To ensure the proper speed of the steam on entering the axial drain 10, the latter may have a variable cross section. It is possible that the axial drain 10 may have a diameter which increases substantially as it advances inside diffuser 7, starting from neck 5.

Figure 4:
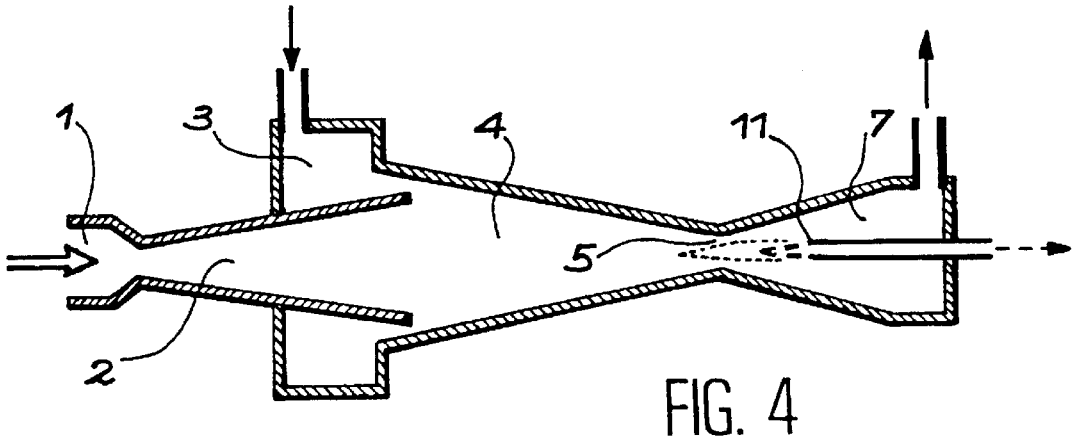
FIG. 4 shows a second embodiment of the injector according to the invention.

With reference to FIG. 4, it is also considered that this axial drain 10 is able to penetrate inside the mixing chamber 4 to ensure evacuation of the steam in more progressive manner. The first part of the drain could then have a conical shape 11 with a sufficient number of evacuation holes.

As suggested by the dashed lines in FIG. 4, in order to combine such technical characteristics, it is also provided that axial drain 10 is able to be mobile longitudinally along the axis of the steam injector of the invention, and is therefore able to be inserted and withdrawn. Consequently it can be withdrawn downstream from neck 5, that is to say in diffuser 7, during start-up of the steam injector. It may be repositioned in the neck 5, once the steam injector rate is set up, to resume its steam evacuation function and its function of reducing the section of the flow passageway in neck 5.

It is specified that all these variants of embodiment of the axial drain 10 enable more precise regulation of steam injector functioning, easier start-up of the latter and the obtaining of maximum output pressure. However, a fixed drain 10 is the solution of reference since it minimizes the number of operations to be conducted.

Figure 5:
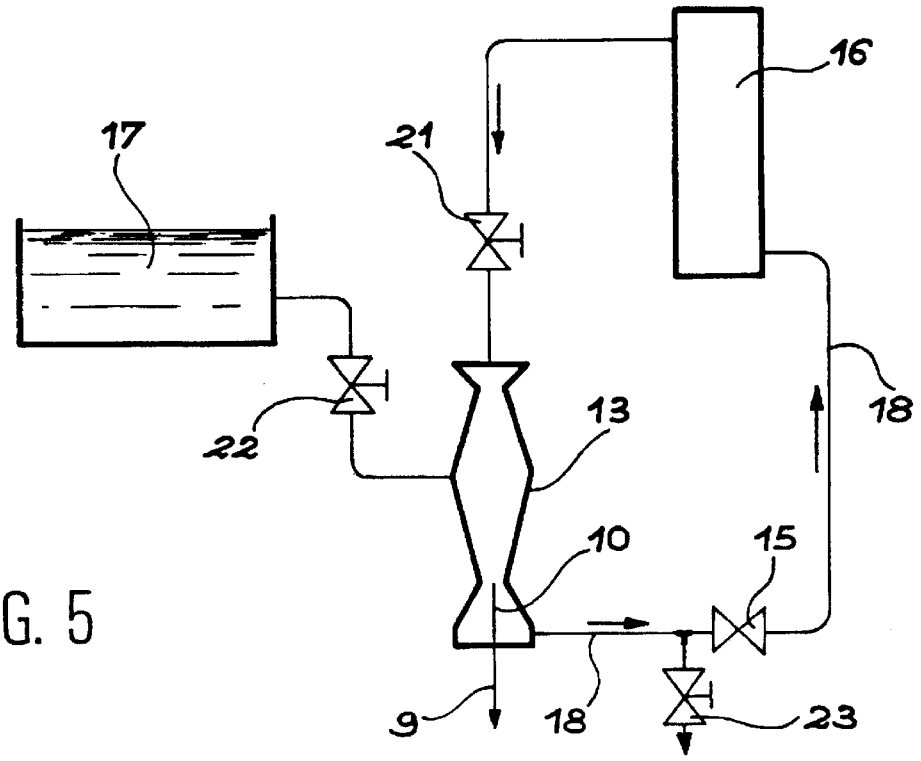
FIG. 5 shows a first example of positioning of the injector of the invention on a steam generator.

With reference to FIG. 5, one first use of the steam injector of the invention is to supply water to a steam generator 16 in a pressurized water reactor. The steam injector 13 is used to inject water into this steam generator 16 using the energy of the steam generated by the latter. A low pressure water reservoir 17 supplies the entry chamber of injector 13 via a feed gate 22 which is therefore closed when the steam injector 13 is not in operation. The latter is therefore at ambient pressure. The axial drain 10 is open and the steam injector 13 may be purged with water or steam. A purge outlet gate 23 is positioned downstream from injector 13 and is also closed.

When the steam generator 16 is in operation, its pressure lies between 10 and 80 bars. An outlet channel 18 which brings the pressurized water leaving the steam injector 13 to the steam generator 16 is shut by a valve 15 which is closed.

The water supply gates 22 and purge outlet gates 23 are then open and the flow of cold water takes place under gravity inside the steam injector 13 and leaves via axial drain 10 and the purge outlet gate 23, the injector being lower than the water reservoir 17.

Then the steam entry gate 21 positioned upstream from the steam injector 13, is opened until a flow of several kg/s is reached according to steam pressure. Condensation in the mixing chamber 4 on the flow of cold water previously obtained enables start-up of the steam injector 13. Once an annular flow is set up at the mixing chamber 4 and neck 5, the axial drain 10 only discharges steam towards the outside 9. The purge outlet gate 23 is then closed, the first part of the outlet channel 18 rises in pressure until it positions the sudden rise in pressure in diffuser 7. When the pressure in the first part of this outlet channel 18 is sufficient, valve 15 opens and the system has then reached nominal functioning. Throughout the latter, the water aspirated from reservoir 17 is injected into the steam generator 16 at the rate of 5 to 20 kg/s depending on the water requirement of the latter, this being obtained by adjusting the water supply gate 22. Stoppage of the system is made by closing the steam supply gate 21, followed by closure of the water supply gate 22.

Several variants of injector installations according to the invention are possible. For example, the water supply gate 22 may be positioned on the outlet line of the axial drain 10, that is to say towards the outside denoted 9. It is then easy to provide for water filling of the system. Start-up is then made under the same conditions as in the basic configuration.

Figure 6:
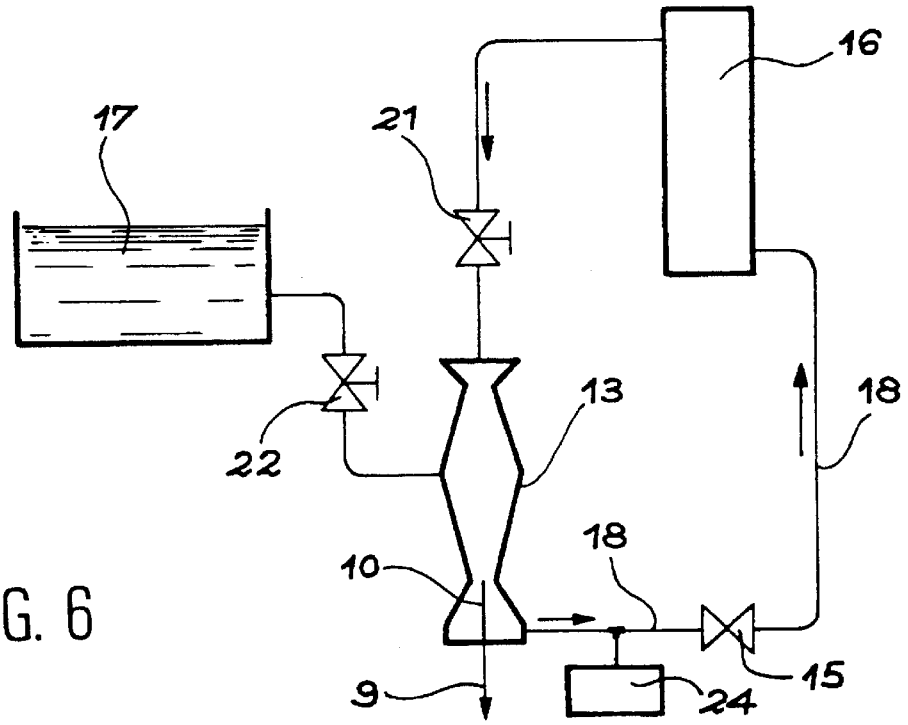
FIG. 6 shows a second example of positioning of the injector of the invention on a steam generator.

As shown in FIG. 6, it may be considered to do away with the outlet gate 23 for the start-up phase of the system. In this case only two gates need to be operated instead of three. Depending upon the size of channel 18, it may then be necessary to insert a primer recipient 24 directly connected onto channel 18 between the steam injector 13 and the valve 15. Positioned initially at ambient pressure, this primer recipient 24 ensures a time delay at the time of rise in outlet pressure before valve 15 is opened.

What is claimed is:

1. High pressure steam injector comprising:

a steam inlet (1) leading into:

a steam nozzle (2) leading into:

a mixing chamber (4);

a ring-shaped entry chamber 3;

a neck (5) positioned at an exit of the mixing chamber (4);

a diffuser (7) positioned at an exit of said neck (5), and an outlet (8) positioned downstream from the diffuser (7), characterized in that said steam injector comprises an axial drain (10) formed of an evacuation duct to reduce a section of the neck (5) and to evacuate some of steam and evacuate said steam towards an outside (9).

2. Injector according to claim 1, characterized in that the axial drain (10) is mobile longitudinally so that said drain (10) can be positioned in or withdrawn from the neck (5) and/or in the mixing chamber (4).

3. Injector according to claim 1, characterized in that the axial drain (10) has a variable section.

4. Injector according to claim 1, characterized in that the axial drain (10), allowing progressive evacuation of the steam, ends in a conical shape (11) in which evacuation holes are provided.

* * * * *

UNITED STATES PATENT AND TRADEMARK OFFICE

CERTIFICATE OF CORRECTION

PATENT NO. : 6,595,163 B2
DATED : July 22, 2003
INVENTOR(S) : Patrick Demaz et al.

It is certified that error appears in the above-identified patent and that said Letters Patent is hereby corrected as shown below:

Title page,
Item [75], Inventors, please delete “Pertius”, and insert therefor -- Pertuis --.
Item [57], ABSTRACT,
Line 8, please delete “Application to the water supply”, to line 9, “water nuclear reactors.”.

Column 1,
Line 60, after “recommended)”, please insert therefor -- . -- (period).

Signed and Sealed this

Twenty-eighth Day of October, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,595,163 B2
DATED : July 22, 2003
INVENTOR(S) : Patrick Dumaz et al.

It is certified that error appears in the above-identified patent and that said Letters Patent is hereby corrected as shown below:

Title page,
Item [75], Inventors, please delete "Pertius", and insert therefor -- Pertuis --.
Item [57], ABSTRACT,
Line 8, please delete "Application to the water supply", to line 9, "water nuclear reactors.".

Column 1,
Line 60, after "recommended)", please insert therefor -- . -- (period).

This certificate supersedes Certificate of Correction issued October 28, 2003.

Signed and Sealed this

Seventeenth Day of February, 2004

JON W. DUDAS
*Acting Director of the United States Patent and Trademark Office*